US006109218A

United States Patent [19]

Bachschmid et al.

[11] Patent Number: 6,109,218

[45] Date of Patent: Aug. 29, 2000

[54] APPARATUS FOR REGULATING THE COOLANT CIRCUIT FOR AN INTERNAL COMBUSTION ENGINE

[75] Inventors: Reiner Bachschmid, Lindau; Clemens Bentele, Gäufelden; Mario Erdmann, Esslingen; Mehmet Haseki, Stuttgart; Peter Moser, Winnenenden; Frederich Schulz, Benningen; Jens Von Gregory, Remshalden, all of Germany

[73] Assignee: Daimler-Benz Aktiengesellschaft, Stuttgart, Germany

[21] Appl. No.: 09/159,190

[22] Filed: Sep. 23, 1998

[51] Int. Cl.[7] ..... F01P 7/14

[52] U.S. Cl. ..... 123/41.09; 123/41.08

[58] Field of Search ..... 123/41.08, 41.09, 123/41.1

[56] References Cited

U.S. PATENT DOCUMENTS

| | | | |
|---|---|---|---|
| 3,302,696 | 2/1967 | Rogers . | |
| 4,332,221 | 6/1982 | Imhof et al. | 123/41.08 |
| 4,399,776 | 8/1983 | Shikata | 123/41.08 |
| 4,834,029 | 5/1989 | Wahnschaffe et al. | 123/41.42 |
| 4,938,185 | 7/1990 | Doke | 123/195 C |
| 5,330,376 | 7/1994 | Okumura | 440/88 |

FOREIGN PATENT DOCUMENTS

| | | |
|---|---|---|
| 292 3523 | 12/1980 | Germany . |
| 195 06 935 | 4/1996 | Germany . |
| 195 08 102 | 7/1996 | Germany . |
| 196 27 655 | 1/1997 | Germany . |
| 61-201816 | 9/1986 | Japan . |
| 08177491 | 7/1996 | Japan . |

*Primary Examiner*—Marguerite McMahon
*Assistant Examiner*—Jason Benton
*Attorney, Agent, or Firm*—Kenyon & Kenyon

[57] ABSTRACT

An apparatus for regulating the coolant circuit for an internal combustion engine is equipped with a radiator and a heating system heat exchanger, a water pump, and a thermostat valve which makes possible two circuits in the warmup phase of the engine or at low engine temperatures, one circuit being provided for cooling the engine via a bypass line, and a second circuit being provided to the heating system heat exchanger via a heating system line. A differential pressure valve, regulated as a function of engine speed, is arranged in the bypass line, the bypass line being blocked, and all of the coolant being passed through the heating system line, in the warmup phase or in the phase with a low engine temperature when the speed of the engine is low; and the differential pressure valve opening and uncovering the bypass line at higher engine speeds, a quantitative distribution of the coolant occurring via the bypass line and the heating system line as a function of the design of the differential pressure valve.

6 Claims, 2 Drawing Sheets

APPARATUS FOR REGULATING THE COOLANT CIRCUIT FOR AN INTERNAL COMBUSTION ENGINE

FIELD OF THE INVENTION

The present invention concerns an apparatus for regulating a coolant circuit for an internal combustion engine.

RELATED TECHNOLOGY

An apparatus for regulating a cooling circuit of an internal combustion engine is described in U.S. Pat. No. 4,972,808. A disadvantage with this apparatus, however, is that during the warmup phase of the engine or during operation for longer periods at low engine speeds, for example in "stop and go" city traffic, sufficient heat for heating the passenger compartment cannot be made available via the heating system heat exchanger. If sufficient heat output is nevertheless desired, additional devices such as, for example, a separate heating device for the heating system heat exchanger and/or hot-water pumps, are necessary.

Reference regarding the existing art in general is also made to German Patent Application No. 43 33 110 A1 and German Patent No. 195 08 102 C1.

SUMMARY OF THE INVENTION

An underlying object of the present invention is to improve an apparatus for regulating a cooling circuit for an internal combustion engine in such a way that in the warmup phase and/or when the vehicle is operated at low engine speeds and low engine temperatures, more heat energy is available for heating the passenger compartment.

The present invention provides an apparatus for regulating the coolant circuit for an internal combustion engine, having a radiator and a heating system heat exchanger, having a water pump, and having a thermostat valve which makes possible two circuits in the warmup phase of the engine or at low engine temperatures, with one circuit being provided for cooling the engine via a bypass line, and a second circuit being provided to the heating system heat exchanger via a heating system line. A differential pressure valve (14), regulated as a function of engine speed, is arranged in the bypass line (7), the bypass line (7) being blocked, and all of the coolant being passed through the heating system line, in the warmup phase or in the phase with a low engine temperature when the speed of the engine (1) is low; and the differential pressure valve (14) opening and uncovering the bypass line (7) at higher engine speeds, a quantitative distribution of the coolant occurring via the bypass line (7) and the heating system line (8) as a function of the design of the differential pressure valve (14).

By way of the differential pressure valve according to the present invention and its manner of connection, maximum heat emission via the heating system heat exchanger is achieved at low engine speeds, especially during the warmup phase of the engine, since the entire coolant volume flows through the heating system, so that the engine heat which is produced can be emitted entirely via the heating system heat exchanger. Only at higher water pump rotation speeds does the differential pressure valve open, and the coolant flow is distributed in known fashion via the bypass line and the heating system line.

In normal vehicle operation, the coolant circuit can be operated conventionally in a mixed mode, and the coolant can be additionally distributed into a return line which passes through the radiator.

BRIEF DESCRIPTION OF THE DRAWINGS

An exemplary embodiment is described in general fashion below with reference to the drawings in which.

DETAILED DESCRIPTION

Figure 1:
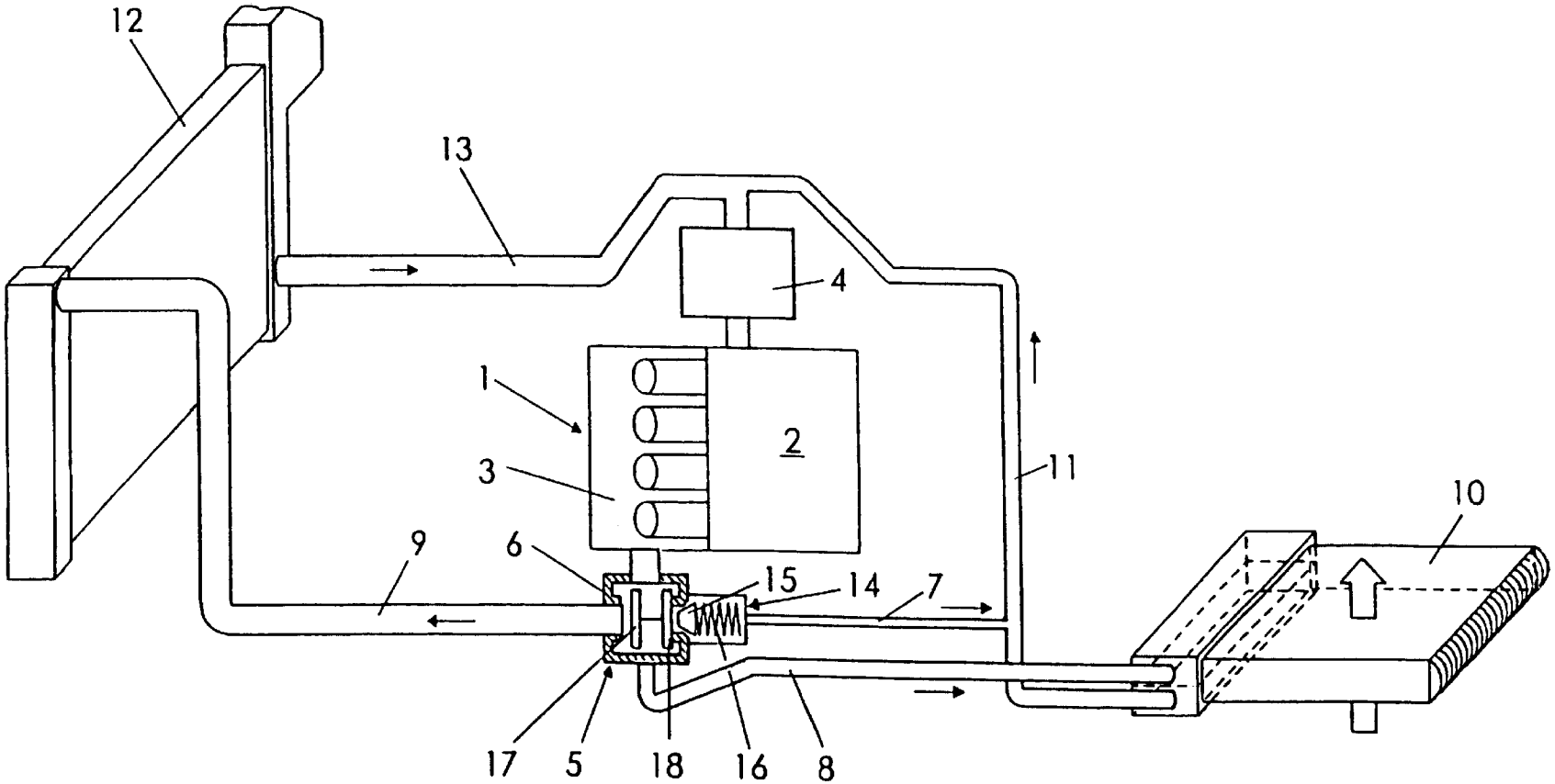
FIG. 1 shows a schematic depiction of a coolant circuit with the differential pressure valve according to the present invention.

The coolant circuit depicted in FIG. 1 is fundamentally of known design in terms of construction and function, and the essential parts will therefore be discussed only briefly below.

An internal combustion engine 1 having a crankcase 2 and a cylinder head 3 is connected via cylinder head 3 to a coolant circuit. The coolant circuit has a water pump 4 which is driven by the engine crankshaft. Located after cylinder head 3 in the flow direction is a thermostat valve 5 in a thermostat housing 6. On the input side thermostat valve 5 is connected to coolant channels of cylinder head 3. On the output side a bypass line 7, a heating system line 8, and a radiator inlet line 9 lead out of thermostat valve 5. Located in heating system line 8 is a heating system heat exchanger 10 which heats a passenger compartment (not depicted). Coolant is returned to water pump 4 via a heating system return line 11 into which bypass line 7 also opens.

Radiator inlet line 9 leads to a radiator 12 from which there proceeds a water pump inlet line 13 leading to water pump 4. Arranged in bypass line 7 is a differential pressure valve 14 which, in the interest of design simplification and simple installation, is integrated into thermostat valve housing 6. Differential pressure valve 14 can, however, of course also be arranged at a different point in bypass line 7 as a separate unit.

Differential pressure valve 14 has a closure member 15 which is preloaded in the closed position by a helical spring 16 constituting the spring device.

Figure 2:
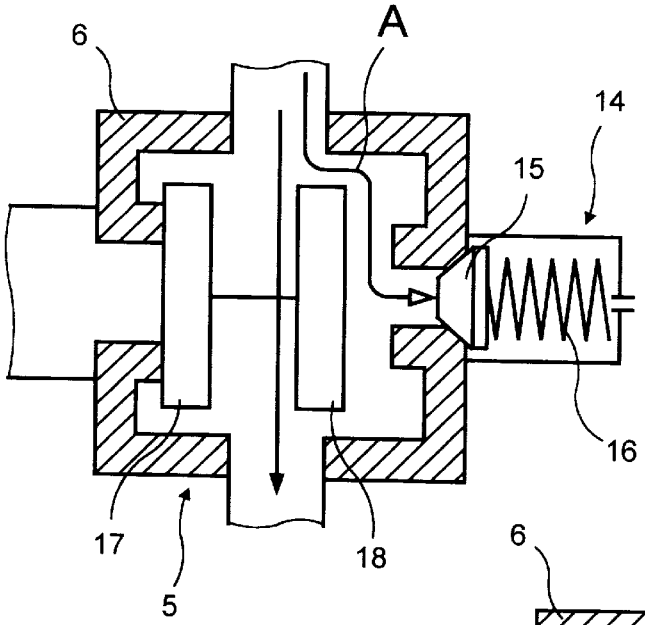
FIG. 2 shows the thermostat valve with the differential pressure valve in short-circuit mode.
Figure 3:
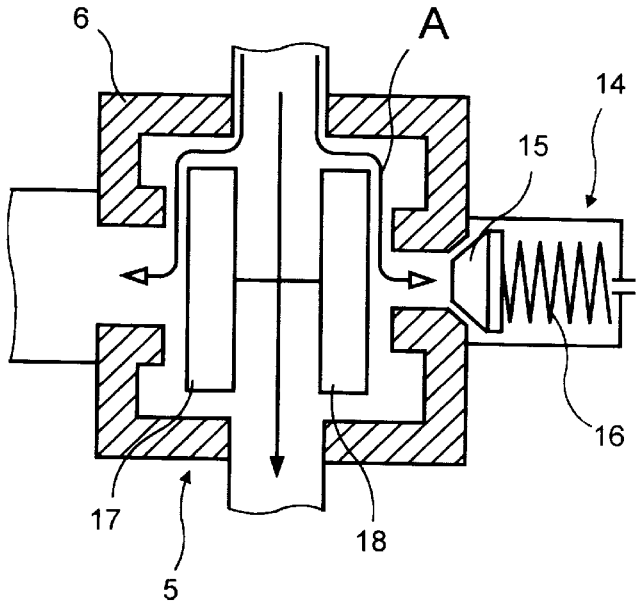
FIG. 3 shows the thermostat valve with the differential pressure valve in the mixed phase.
Figure 4:
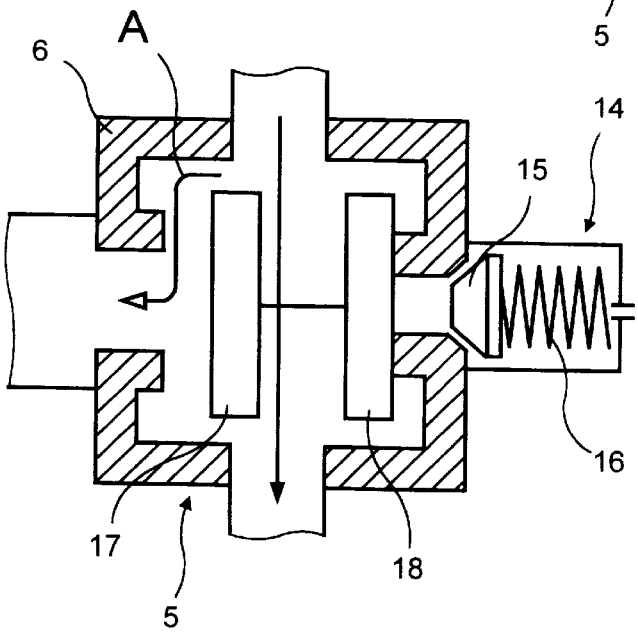
FIG. 4 shows the thermostat valve with the differential pressure valve in the normal operating state.

Thermostat valve 5 depicted in FIG. 1 and in more detail in FIGS. 2 through 4 is configured as a two-plate valve having valve plates 17 and 18. A different thermostat valve configuration is of course also possible, however, in the context of the present invention.

The manner of operation of differential pressure valve 14 will be described below with reference to the various positions shown in FIG. 1 and, in enlarged fashion, in FIGS. 2 through 4.

FIG. 2 shows a short-circuit mode during the warmup phase of engine 1 at low engine speeds and thus also at a low water pump rotation speed. In this case, thermostat valve 5 is connected, in known fashion, in such a way that valve plate 17 blocks off radiator inlet line 9 leading to radiator 12. In the existing art, this would result in a distribution of the coolant flow to heating system line 8 and bypass line 7, so that the heat energy available for heating system heat exchanger 10 would be correspondingly reduced and, because of the low engine speed and low temperature of the engine, would be insufficient to heat a passenger compartment. Differential pressure valve 14 is provided in order to eliminate this negative effect. Because of the low pressure, the pressure present in the coolant circuit is correspondingly low, and is not enough to overcome the preload force of spring device 16 for closure member 15. This means that differential pressure valve 14 is in the closed position depicted in FIG. 2, in which valve plate 17 blocks off the inflow opening to radiator inlet line 9 because of the low engine temperature. As a result, all of the coolant is fed into heating system line 8, and thus made available to heating system heat exchanger 10.

In the depiction of FIG. 2, valve plate 18 is located at a distance from the inflow opening into bypass line 7, but because of the low engine speed, closure member 15 of differential pressure valve 14 keeps bypass line 7 closed. Only above a preselected engine speed, and thus a correspondingly higher pressure in the coolant circuit, does bypass line 7 open as a function of the preload of helical spring 16. This can occur, for example, at a pressure of approximately 0.3 bar and higher. Only above this design point does a partial flow (corresponding to arrow A in FIG. 2) occur into bypass line 7 through closure member 15 as it opens, in addition to the coolant flow via heating system line 8.

When the engine temperature has reached a preselected value, e.g. greater than 80° C., thermostat valve 5 opens, in known fashion, for a mixed phase (see FIG. 3). In this, the two valve plates 17 and 18 are in a middle position in which all the outputs from thermostat valve housing 6 are open, i.e. bypass line 7, heating system line 8, and radiator inlet line 9. This phase denotes the beginning of coolant flow through radiator inlet line 9 and flow through radiator 12, then returning to water pump 4 via water pump return line 13. In this case as well, it is possible for closure member 15 of differential valve 14 to be closed at low engine speeds, thus once again delivering more heat energy to heating system heat exchanger 10.

FIG. 4 shows the position of the two valve plates 17 and 18 in the normal operating state, e.g. at temperatures exceeding 100° C. As is evident, in this instance thermostat valve 5 is completely open in the direction of radiator inlet line 9 and heating system line 8, and bypass line 7 has been closed by valve plate 18. Coolant flow as shown in FIG. 4 thus corresponds to the known coolant flow according to the existing art.

What is claimed is:

1. An apparatus for regulating a coolant circuit for an internal combustion engine, the coolant circuit having a radiator, a heating system heat exchanger, a coolant pump, a first coolant circuit for coolant flowing through the radiator and a second coolant circuit for the coolant flowing through the heat system heat exchanger, the apparatus comprising:

a thermostat valve connected to the first coolant circuit, to the second coolant circuit and to a bypass line leading to the second coolant circuit, the thermostat valve capable of providing the coolant to the bypass line and to the second coolant circuit during a warmup or low engine temperature phase of the internal combustion engine, and capable of closing off said bypass line; and a differential pressure valve regulated as a function of engine speed and disposed in the bypass line, the differential pressure valve blocking the bypass line in the warmup or low engine temperature phase when a speed of the internal combustion engine is below a certain value so that the coolant passes completely through the second coolant circuit, the differential pressure valve opening and uncovering the bypass line when a speed of the internal combustion engine equals or exceeds the certain value so that the coolant is distributed quantitatively to the bypass line and the second coolant circuit as a function of a regulation of the differential pressure valve.

2. The apparatus as recited in claim 1 wherein the differential pressure valve has a spring device for preloading the differential pressure valve in a closed direction.

3. The apparatus as recited in claim 1 wherein the differential pressure valve is received in a thermostat housing of the thermostat valve.

4. The apparatus as recited in claim 1 wherein the thermostat valve is configured as a plate valve having at least one valve plate, the bypass line branching off after the at least one valve plate.

5. The apparatus as recited in claim 4 wherein the at least one valve plate includes a first and a second valve plate, the bypass line branching off after the first valve plate, and a radiator inlet line of the second coolant circuit leading to the radiator and branching off after the second valve plate.

6. An internal combustion engine comprising:

a radiator for cooling the internal combustion engine;

a heating system heat exchanger for heating a passenger compartment;

a coolant pump for pumping coolant;

a first coolant circuit for the coolant flowing through the radiator;

a second coolant circuit for the coolant flowing through the heat system heat exchanger;

a thermostat valve connected to the first coolant circuit, to a second coolant circuit and to a bypass line leading to the second coolant circuit, the thermostat valve capable of providing the coolant to the bypass line and to the second coolant circuit during a warmup or low engine temperature phase of the internal combustion engine, and capable of closing off said bypass line; and a differential pressure valve regulated as a function of engine speed and disposed in the bypass line, the differential pressure valve blocking the bypass line in the warmup or low engine temperature phase when a speed of the internal combustion engine is below a certain value so that the coolant passes completely through the second coolant circuit, the differential pressure valve opening and uncovering the bypass line when a speed of the internal combustion engine equals or exceeds the certain value so that the coolant is distributed quantitatively to the bypass line and the second coolant circuit as a function of a regulation of the differential pressure valve.

* * * * *